United States Patent [19]

Brockett et al.

[11] 4,027,065

[45] May 31, 1977

[54] PRESSURE-SENSITIVE RECORD MATERIAL

[75] Inventors: Bruce W. Brockett, Appleton, Wis.; Frederick D. Weaver, Chillicothe, Ohio

[73] Assignee: NCR Corporation, Dayton, Ohio

[22] Filed: Apr. 28, 1975

[21] Appl. No.: 570,050

[52] U.S. Cl. ..... 428/307; 428/323

[51] Int. Cl. ..... B41m 5/00

[58] Field of Search ..... 427/150, 261; 428/411, 428/307, 323

[56] References Cited

UNITED STATES PATENTS

| | | | |
|---|---|---|---|
| 3,627,581 | 12/1971 | Phillips | 106/137 X |
| 3,663,256 | 5/1972 | Brockett et al. | 282/27.5 |
| 3,672,935 | 6/1972 | Miller et al. | 282/27.5 |
| 3,681,390 | 8/1972 | Lin | 260/335 |
| 3,723,156 | 3/1973 | Brockett et al. | 282/27.5 |
| 3,732,120 | 5/1973 | Brockett et al. | 428/307 |

*Primary Examiner*—Bernard D. Pianalto
*Attorney, Agent, or Firm*—E. Frank McKinney

[57] ABSTRACT

Record material is disclosed comprising paper sheet material coated with droplets of liquid wherein the liquid comprises 2,2,4-trimethyl-1,3-pentanediol diisobutyrate. Said liquid is associated on the record material with at least two color-producing reactants, at least one of which is soluble in said liquid. The liquid is associated with the reactants by either being in close proximity to both reactants or by having one of the reactants dissolved therein and being in close proximity to the other. Of the color-producing reactants, one is a chromogenic dye-precursor and one is a coreactant material capable of developing the color of the chromogenic dye-precursor when the two reactants are brought into reactive contact.

12 Claims, No Drawings

PRESSURE-SENSITIVE RECORD MATERIAL

BACKGROUND OF THE INVENTION

1. Field of the Invention

This invention provides record material comprising paper sheets coated with isolated liquid droplets which include 2, 2, 4-trimethyl-1, 3-pentanediol diisobutyrate. Said isolated liquid droplets are associated, on the record material, with at least two color-producing reactants, at least one of which is soluble in said liquid. The liquid is associated with the reactants either by being in close proximity to both reactants or by having one of the reactants dissolved therein and being in close proximity to the other. Of the color-producing reactants, one is a chromogenic dye-precursor and one is a coreactant material capable of developing the color of the chromogenic dye-precursor when the two reactants are brought into reactive contact by rupture of the isolating medium, Isolation of the liquid droplets is preferably accomplished by encapsulation of the droplets with pressure-rupturable, solid, polymeric, film material.

2. Description of the Prior Art

In the art of making pressure-sensitive record material, of the type described, which includes liquid-containing-microcapsules, successful commerical embodiments have made use of Crystal Violet Lactone (hereinafter called CVL) as chromogenic dye-precursor material, and acidic coreactant material such as attapulgite clay or an oil-soluble, para-substituted-phenol-aldehyde novolak resin, and a liquid solvent that is at least in part isopropyl-biphenyl as disclosed in U.S. Pat. No. 3,627,581, issued Dec. 14, 1971 on the application of P. S. Phillips, Jr. Isopropyl-biphenyl has a low vapor pressure and good solvent power and is readily retained by gelatin films (a widely used capsular wall material). Isopropyl-biphenyl has, therefore, served well as a solvent in pressure-sensitive record material systems of the type disclosed. U.S. patent application Ser. No. 522,001, filed Nov. 8, 1974, in the name of Erland C. Porter, Jr., which is a continuation of U.S. patent application Ser. No. 326,361, filed Jan. 24, 1973 now abandoned, discloses that ethyldiphenylmethane provides print intensity and fade resistance improved over isopropyl-biphenyl when used with a dye system including CVL and with standard commercial receiving sheets sensitized, for example, according to the teaching of U.S. Pat. No. 3,663,256, issued May 16, 1972 on the application of R. E. Miller and B. W. Brockett.

SUMMARY OF THE INVENTION

It has been discovered that 2, 2, 4-trimethyl-1, 3-pentanediol diisobutyrate exhibits especially good chracteristics for use in color-developing record sheet systems. Being a non-aromatic liquid, the diisobutyrate has no unpleasant odor and, compared to other non-aromatic liquids, has solvent power and associated qualities which appear to singularly suit the diisobutyrate for use in pressure-sensitive systems with acid-base color development. 2, 2, 4-trimethyl-1, 3-pentanediol diisolbutyrate has been found to provide better fade resistance than solvents previously known and used in sheets of the kind herein discussed.

As compared with other solvent materials, the 2, 2, 4-trimethyl-1, 3-pentanediol diisobutyrate disclosed herein permits realization of several objects in regard to commercial pressure-sensitive record systems. The diisobutyrate is not halogenated and, moveover, as stated above, is not aromatic. It has recently been the case that halogenated solvents are not desirable and, sometimes, the use of halogenated solvents has been forbidden for ecological reasons. There is presently some belief that certain aromatic solvents may be subjected to a similar prohibition in the future. Until the present time, solvents which are both unhalogenated and non-aromatic have not found universal acceptance.

It has been discovered that the kind of solvent used in pressure-sensitive record material has an effect on the character of the developed image and on the speed at which the image develops. Generally, aromatic solvents, and especially, halogenated aromatic solvents, have exhibited adequate solvency without interference with the acid-base color reaction. Use of non-aromatic solvents; and, to some extent, use of unhalogenated aromatic solvents, however, has resulted in delayed development of color and in decreased resistance to color fade. 2,2, 4-trimethyl-1, 3-pentanediol diisobutyrate is a non-aromatic, unhalogenated, solvent which does not interfere significantly with the speed of color development and which does not cause decreased resistance to fade.

Nonhalogenated diluent oils may be added to the diisobutyrate without adversely affecting the performance of the record systems made therewith. High-boiling aliphatic hydrocarbons and $C_{10}$–$C_{15}$-alkylbenzenes, although not preferred, have been used successfully as diisobutyrate diluents. Since these diluents are generally less expensive than the diisobutyrate, their use is in the interest of economy. Solubility of the chosen colorless, chromogenic dye-precursor material in the chosen diluent dictates the maximum amount of such diluent which can be used. If the diisobutyrate is to be diluted with other oils, the diluted diisobutyrate should be capable of dissolving at least one percent and preferably 1.5 percent or more of the chosen dye-precursor. When CVL is the chosen dye-precursor, the preferred diluents are saturated aliphatic hydrocarbon oils (with a distillation range in the range of 188° to 260° C), which may be added to the diisobutyrate to make up as much as one-third of the total weight of the CVL solvent.

Of course, in addition to the preferred diluent hydrocarbon oils discussed above, many oils known in this art as useful capsule internal phase solvents, may be used as a diluent herein for the diisobutyrate provided they are not halogenated, are at least partially miscible with the diisobutyrate so as to give a single phase in the proportions used, and are not chemically reactive with the diisobutyrate or with the other components of the marking liquid.

Dye-precursor materials in addition to CVL which may be dissolved in the diisobutyrate, for encapsulation purposes, include any colorless, chromogenic dye-precursor materials such as those disclosed in U.S. Pat. No. 3,672,935, issued June 27, 1972 on the application of Robert E. Miller and Paul S. Phillips, Jr., and dialkylaminofluoran chromogenic compounds such as disclosed in U.S. Pat. No. 3,681,390, issued Aug. 1, 1972 on the application of Chao-Han Lin. Examples of these materials are 2′-(2-carboxyanilino)-6′-diethylaminofluoran; 2′-(2-carbomethoxyanilino)-6′-diethylaminofluoran; 2′-anilino-6′-diethylaminofluoran; 2′-(3-carboxy-2-naphthylamino)-6′-diethylaminofluoran; 2′-(3-carbomethoxy-2-naphthylamino)-6′-diethylaminofluoran; 2'-(2-carboxyanilino)-6'-diethylamino-3'-methylfluoran; 2'-(2-carbomethoxyanilino)-6'-diethylamino-3'-methylfluoran; 2'-anilino-6'-diethylamino-3'-methylfluoran; 2'-(3-carboxy-2-naphthylamino)-6'-diethylamino-3'-methylfluoran; 2'-(3-carbomethoxy-2-napthylamino)-6'-diethylamino-3'-methylfluoran 5-(2-carboxyanilino)-2'-chloro-6'-diethylamino-3'-methylfluoran; and 6-(2-carboxyanilino)-2'-chloro-6'-diethylamino-3'-methylfuoran.

Phenol-aldehyde resins of the novalak type are generally eligible for use in this invention. Examples of phenol-aldehyde resins which can be used as coreactant materials to develop the color of the dye-precursor materials are those disclosed in the aforementioned U.S. Pat. No. 3,672,935, preferably in a metal-modified form.

Still further useful phenol-aldehyde resins are oil-soluble metal salts of phenol-aldehyde novolak resins, for example, the zinc salt of para-octylphenol-formaldehyde resin, disclosed in U.S. Pat. No. 3,732,120, issued May 8, 1973 on the application of B. W. Brockett, R. E. Miller and M. L. Hinkle. Each of an oil-soluble, water-insoluble, metal salt such as zinc(II) 2-ethylhexanoate and an oil-soluble phenol-aldehyde novolak resin, for example, a para-phenylphenol-formaldehyde resin, may be provided on the same sheet as coreactant materials, as disclosed in U.S. Pat. No. 3,723,156, issued Mar. 27, 1973 on the application of B. W. Brockett, R. E. Miller and M. L. Hinkle.

Other acid-reacting, color-forming materials eligible for use herein include ortho-hydroxy aryl carboxylic acid materials, preferably combined with a metal. Preferred carboxylic acid materials are salicylic acid derivatives such as diisopropyl salicylic acid, ditertbutyl salicylic acid, and butyl methyl salcylic acid.

Capsule wall materials and capsule manufacture are not critical to this invention. Suitable capsules may be made according to the procedures taught in U.S. Pat. No. 2,800,458 (issued July 23, 1957) which became U.S. Pat. No. Re. 24,899 (issued Nov. 29, 1960), U.S. Pat. No. 2,800,457 (issued July 23, 1957), and U.S. Pat. No. 3,041,289 (issued June 26, 1962). Other methods of isolating the marking droplets are also applicable here, such as entrapment of the droplets in a dried emulsion film.

Suitable procedures for making droplet-coated record sheets are taught in U.S. Pat. No. 2,711,375 (issued June 21, 1955), U.S. Pat. No. 2,712,507 (issued July 5, 1955), U.S. Pat. No. 2,730,456 (issued Jan. 10, 1956) and in the previously cited U.S. Pat. No. 3,672,935. The various configurations, arrangements and locations of the solvent of this invention, the dye-precursor, the coreactant materials, and the capsules which contain one or more of these components within two-sheet couplet record material or single sheet self-contained material are described in detail in the U.S. Pat. No. 3,672,935.Any such configuration can be employed for purposes of this invention.

The preparation and use of record material incorporating 2,2,4-trimethyl-1, 3-pentanediol diisobutyrate is taught in detail in the following examples. All ratios, compositional parts, or percent composition figures herein are parts by weight or weight percents, unless otherwise indicated. All solutions are aqueous unless otherwise specified.

DESCRIPTION OF THE PREFERRED EMBODIMENTS

EXAMPLE 1

Encapsulation of CVL-Diisobutyrate Solution.

A solution of CVL, 1.7 percent, in 2,2, 4-trimethyl-1, 3-pentanediol diisobutyrate is chosen for use as the internal phase of capsules in this Example. The following formulation is emulsified at 55° centigrade to give internal phase droplets about 4 microns in diameter:

150 parts of internal phase
150 parts of 10 percent gelatin at pH 6.5
62 parts of deionized water.

Coacervation is accomplished by addition to the above emulsion, under continued agitation at 55° centigrade, of 100 parts of 10 percent gum arabic solution, 10 parts of 5 percent poly(vinyl methyl ether-comaleic anhydride) (PVM/MA solution and 600 parts of deionized water. With continued agitation and temperature maintenance, the mixture is treated with sufficient 20 percent sodium hyrodxide solution to adjust the pH to 9.0 and is then treated with 12.5 parts of 14 percent acetic acid, added dropwise. The mixture is then cooled slowly, with continued agitation, to 12° centigrade and treated with 7.5 parts of 25 percent glutaraldehyde. After 4 hours of stirring, 12.0 parts of 5 percent PVM/MA solution (pH 9.0 ) is added, dropwise, to the mixture which is then stirred for an additional 2.5 hours while it gradually warms to about room temperature. The pH of the mixture, which is now a suspension of microcapsules, is finally adjusted to 9.5 with 20 percent sodium hydroxide. The microcapsules may be used as is, as an aqueous suspension, or they may be isolated by filtration and air-dired.

EXAMPLE 2

Encapsulation of CVL-Diisobutyrate-Hydrocarbon oil.

According to the procedure of Example 1, microcapsules are made wherein a 2:1 mixture of 2,2 4-trimethyl-1,3-pentanediol diisobutyrate and a saturated hydrocarbon oil (distillation range 188°–260° centigrade) is substituted for the diisobutyrate of that example.

EXAMPLE 3

Encapsulation of CVL-Dioctyl phthalate-Hyrdocarbon oil.

According to the procedure of Example 2, microcapsules are made wherein dioctyl phtalate is substituted for the diisobutyrate of that example.

EXAMPLE 4

Encapsulation of CVL-Dioctyladipate-Hydrocarbon oil.

According to the procedure of Example 2, microcapsules are made wherein dioctyl adipate is substituted for the diisobutyrate of that example and the mixture is 3:1 dioctyl adipate and hydrocarbon oil, as required for suitble solvent power.

EXAMPLE 5

Encapsulation of CVL-Isopropylbiphenyl-Hydrocarbon oil

According to the procedure of Example 2, microcapsules are made wherein isopropylbiphenyl is substituted for the diisobutyrate of that example. The isopropylbiphenyl is commonly a mixture of components, as described in previously-cited U.S. Pat. No. 3,627,581.

EXAMPLE 6

Record Material Sheets Coated with the Capsules of Examples 1–5

An aqueous coating slurry of the following composition is made up by combining:

| | Parts (Wet) | Parts (Dry) |
|---|---|---|
| Capsules | 485 | 100 |
| Arrowroot Starch Granules | 24 | 24 |
| Cooked Cornstarch | 50 | 10 |
| Water | 41 | — |

Paper sheets are coated with the above slurry with a No. 15 Mayer rod to give a dried coating weight of about 7.5 grams per square meter.

Coatings made with the capsules of any of Examples 1, 2,3, 4 or 5 give record material sheets that yield blue marks when marked on aginst acid-sensitized receiving sheets. The test receiving sheets can be standard commerical receiving sheets sensitized, for example, according to the teaching of the previously cited U.S. Pat. No. 3,732,120. The capsules of Examples 1 and 2 contain the solvent of this invention, however; and test results comparing capsules from Examples 1 and 2 with capsules from Examples 3, 4, and 5 are described below, after Example 7.

EXAMPLE 7

Receiving Sheets for Tests with Capsules of Examples 1–5

Two kinds of phenolic resin and a salicylic acid derivative are used to prepare receiving sheets.

The phenolic resins are para-phenylphenol-formaldehyde and para-octylphenol-formaldehyde novolak resins and are metal-modified in accordance with the procedure disclosed in U.S. Pat. No. 3,737,410 (issued June 5, 1973). To summarize that procedure, 100 parts of the phenolic resin, 7.5 parts of ammonium bicarbonate, and 12.5 parts of zinc dibenzoate are fused together to achieve a chemical reaction and, then, the mass is attrited in an aqueous vehicle.

a. Metal-modified para-phenylphenol-formaldehyde resin receiving sheet.

The resin is coated, as a slurry with fillers and binders, onto a paper substrate and dried. The formulation and procedures are also disclosed in the above-cited U.S. Pat. No. 3,737,410. To summarize, a slurry of the following formulation is coated to yield a weight of about 8.5 grams per square meter:

| | Parts (Wet) | Parts (Dry) |
|---|---|---|
| zinc-modified resin | 26.0 | 13.0 |
| kaolin clay | 62.0 | 62.0 |
| calcium carbonate | 9.0 | 9.0 |
| styrene-butadiene latex binder | 12.0 | 6.0 |
| cooked starch binder | 100.0 | 10.0 |
| water | 191.0 | — |
| | 400.0 | 100.0 |

b. Metal-modified para-octylphenol-formaldehyde resin receiving sheet

This sheet is identical with the sheet of (a), above, as to formulation and preparation with the exception that zinc-modified para-octylphenol-formaldehyde resin is substituted for previously-used zinc-modified para-phenylphenol-formaldehyde resin.

c. Metal-modified salicylic acid derivative receiving sheet

The metal modification is accomplished by combining 30 parts of zinc oxide and 10 parts of 3, 5-di-t-butylsalicylic acid in 210 parts of water and, if desired, a few parts of a dispersing agent. About 16 parts of 28 percent ammonium hydroxide is added to the combination with agitation and the resulting system is permitted to stand for about 16 hours.

About 66 parts of the metal/salicylic acid dispersion is combined with about 74 parts of kaolin clay and 148 parts of additional water. To that combination is added starch and latex binders as in (a), above, and according to the formulation below:

| | Parts (Wet) | Parts (Dry) |
|---|---|---|
| zinc-salicylic acid derivative | 66 | 10 |
| kaolin clay | 74 | 74 |
| styrene-butadiene latex binder | 12 | 6 |
| cooked starch binder | 100 | 10 |
| water | 148 | — |
| | 400 | 100 |

The slurry is coated to yield a weight of about 8.5 grams per square meter.

Capsules from Examples 1–5, coated onto sheets in Example 6, are used to mark the receiving sheets made in Example 7.

Typewriter Intensity*

| Capsule Coated Sheets → / Receiving Sheets ↓ | Example 1 | 2 | 3 | 4 | 5 |
|---|---|---|---|---|---|
| Example 7(a) | 63 | 63 | 87 | 89 | 64 |
| 7(b) | 72 | 69 | 87 | 89 | 70 |
| 7(c) | 68 | 70 | 97 | 94 | 70 |

The Typewriter Intensity values have been determined after exposure of the print for 24 hours to fluorescent light.

Capsule sheets utilizing the diisobutyrate solvent of this invention are presented in the two left-hand columns of the tables above. Prints using the diisobutyrate solvent are seen to be much darker than prints using either the dioctyl phthalate of Example 3 or the non-aromatic dioctyl adipate of Example 4. Prints using the aromatic isopropylbiphenyl of Example 5 appear to be comparable with the non-aromatic diisobutyrate prints in regard to print intensity.

EXAMPLE 8

In this example, 2,2, 4-trimethyl-1, 3-pentanediol diisobutyrate is compared with ethyldiphenylmethane as solvent internal phase for a colorable system having a combination of several dyes. The method for manufacturing the capsules can be the same as that of Example 1, above. The dye system is the same in both solvents and includes: CVL, a red phtahalide such as 3, 3-bis(1-ethyl-2-methylindol-3-yl)phthalide; a neutral fluoran such as 2'-anilino-6'-diethylamino-3'-methylfluoran and benzoyl leuco methylene blue.

The diisobutyrate vehicle is a 2:1 mixture of the diisobutyrate with hydrocarbon oil, as specified in Example 2, above.

The ethyldiphenylmethane vehicle is also a 2:1 mixture with that same hydrocarbon oil. The ethyldiphenylmethane commonly includes several percent of impurities in the form of dibenzylethylbenzene and polybenzylethylbenzene.

Coating compositions and coated sheets are prepared in accordance with Example 6, above, and using the capsules of this Example 8. Those coated sheets are used against the receiving sheet of Example 7(c), above.

Typewriter Intensity values are as follows:

| | 24-hour fluorescent light exposure | 1 month laboratory wall exposure |
|---|---|---|
| ethyldiphenylmethane vehicle | 88 | 86 |
| diisobutyrate vehicle | 70 | 71 |

The fluorecent light exposure is the same as previously described. The laboratory wall exposure is exposure of a print by hanging the printed sheet on the laboratory wall, exposed to air, natural and fluorescent room light, and ambient temperature and moisture levels. Laboratory wall exposure provides some indication of environmental print stability.

Prints using the non-aromatic diisobutyrate exhibit increased fade resistance when compared to the prints using the aromatic ethyldiphenylmethane.

EXAMPLE 9

Encapsulation of Phenol-Aldehyde Resin Solution

Generally following the method of Example 1, a 10 percent solution of para-octylphenol-formaldehyde novolak resin or para-phenylphenol-formaldehyde novolak resin in 2,2, 4-trimethyl-1, 3-pentanediol diisobutyrate solvent vehicle is encapsulated. The initial emulsion consists of 180 parts of internal phase, 191 parts of 11 percent gelatin at pH 4.3 and 15.8 parts of deionized water. Coacervation is accomplished by the addition of 127 parts of 11 percent gum arabic solution, 13.5 parts of 5 percent poly(vinylmethylether-co-maleic anhydride) (PVM/MA) solution and 817 parts of deionized water. In the final stages, 21 parts of 14 percent acetic acid, 10 parts of 25 percent glutaraldehyde, and 20 parts of basic 5 percent PVM/MA solution are added instead of the amounts specified in Example 1. The final stirring times are also changed: 16 hours following the glutaraldehyde addition and one hour following the final basic PVM/MA addition. The final adjustment of the pH to 9.5 is omitted.

When coated sheets bearing the capsules of Example 9 are used as the transfer sheet against a facing receiving sheet that has been sensitized by being dipped in an acetone solution of a colorless, chromogenic, dye-precursor and dried, intense, highly-colored, marks are developed and the marks exhibit good resistance to fade. Among the colorless, chromogenic, dye-precursor materials eligible for use in this test are CVL, Malachite Green Lactone, N-(2,5-dichlorophenyl)-leucauramine, N-benzoylauramine, Methyl Red, 4-aminoazobenzene, methoxybenzoindolinospiropyran and Rhodamine B Lactam. A metal compound, such as a zinc resinate, is preferably used with the dye-precursors on the receiving sheet coating.

The diisobutyrate resin solvent vehicle can include up to about one-third of a diluent oil, such as the previously-disclosed hydrocarbon oil.

EXAMPLE 10

The diisobutyrate of this invention is used in dissolving color developing components other than the chromogenic dye compounds. In this example, a receiving sheet is prepared which includes the chromogenic material in the coating. That receiving sheet is used to compare a capsule coated sheet of phenolic resin dissolved in 2,2,4-trimethyl-1,3-pentanediol diisobutyrate with a capsule coated sheet of the same phenolic resin dissolved in ethyldiphenylmethane.

a. The Receiving Sheet

A Crystal Violet Lactone (CVL) glass is prepared by melting together: 1 part of CVL as a chromogenic material; 5 parts of zinc resinate as a stabilizing diluent; and 1 part of octadecyl alcohol as a plasticizing solvent. The molten mass is allowed to cool and it then pulverized.

To make a coating composition for receiving sheet 3.9 parts of the CVL glass, 5 parts of zinc oxide and 40 parts of calcuim carbonate are attrited for about 30 minutes with about 115 parts of water; and then 33 parts of kaolin, 160 parts of 10 percent starch and 2 parts of zinc phenol sulfonate are added and the pH of the system is adjusted to about 8.5 using ammonium hydroxide.

The coating composition is applied to sheets in a weight of about 8.5 grams per square meter, when dried.

b. The Capsule-Coated Sheets i. Microcapsules are made using a 2:1 mixture of 2,2,4-trimethyl-1,3-pentanediol diisobutyrate and a saturated hydrocarbon oil (distillation range 188°–260° centigrade) with about 5.4 percent 2,2'-thiobis(3,5-dichlorophenol) and about 13.6 percent para-phenylphenol resin such as that disclosed in previously cited U.S. Pat. No. 3,663,256, as a color developing reactant. ii. Microcapsules are made exactly as above in (i) with the exception that ethyldiphenylmethane is substituted for the 2,2,4-trimethyl-1,3-pentanediol diisobutyrate.

Record material sheets are made as in Example 6, above, by coating a slurry of the following composition:

| | Parts (Wet) | (Dry) |
|---|---|---|
| Capsules | 485 | 100 |
| Arrowroot starch granules | 24 | 24 |
| Cooked cornstarch | 50 | 10 |
| Water | 41 | — |

onto sheets to give a dried coating weight of about 4.5 grams per square meter.

The capsule coated sheets of Example 10(b) are tested against the receiving sheet of Example 10(a) with the following results:

| | Initial | 1 hour | 24 hours | 24 hour fluorescent light exposure |
|---|---|---|---|---|
| Example 10(b)(i) diisobutyrate vehicle | 67 | 60 | 54 | 76 |
| Example 10(b)(ii) ethyldiphenylmethane vehicle | 84 | 77 | 74 | 95 |

The diisobutyrate of this invention results in a record sheet material of greatly improved overall quality, when compared with the ethyldiphenylmethane vehicle of the prior art.

EXAMPLE 11

In this example, 2,2, 4-trimethyl-1, 3-pentanediol diisobutyrate is used, in 6 to 1 ratio with tributyl phosphate to dissolve N, N'-dibenzyldithiooxamide. The dithiooxamide is encapsulated and used as capsule-containing color reactant against a receiving sheet coated with a nickel compound. N, N'-di-organo-substituted dithiooxamides are generally eligible. Another preferred material is N, N'-didodecyldithiooxamide.

The capsule coating composition is made up in the same way as disclosed previously and the receiving sheet can be made by combining 9 parts of nickel stearate, 3 parts of octadecyl alcohol and 71 parts of calcium carbonate in 194 parts of water under violent agitation. To that mixture are added 2 parts of starch and 15 parts of latex binder as previously disclosed.

What is claimed is:

1. Record sheet material comprising a paper sheet having a coating comprising encapsulated isolated droplets of an oil solution of a color-producing reactant material selected from the group consisting of a chromogenic dye-precursor material and an acidic co-reactant material capable of producing color when brought into reactive contact with a material selected from the group consisting of an acidic co-reactant material and a chromogenic dye-precursor, respectively, wherein said oil comprises 2, 2, 4-trimethyl-1, 3-pentanediol diisobutyrate and dissolves at least one percent of the chromogenic dye-precursor.

2. The record sheet material of claim 1 whrein the color-producing reactant material is selected from the group consisting of base-reacting colorless chromogenic dye-precursor materials and acid-reacting materials selected from the group consisting of phenol-formaldehyde novolak resins and ortho-hydroxy aryl carboxylic acid materials capable of producing color in said dye-precursors when brought into reactive contact therewith.

3. The record sheet material of claim 2 in which the oil comprises at least about two-thirds, by weight, 2,2 4-trimethyl-1,3-pentanediol diisobutyrate.

4. The record sheet material of claim 3 in which the oil additionally comprises a high-boiling saturated alphatic hydrocarbon oil.

5. The record sheet material of claim 4 in which the saturated aliphatic hydrocarbon oil is present in an amount up to about one-third of the total weight of the oil.

6. The record sheet material of claim 2 in which the color-producing reactant material is a base-reacting colorless chromogenic dye-precursor material.

7. The record sheet material of claim 2 in which the color-producing reactant material is a phenol-formaldehyde novolak resin.

8. The record sheet material of claim 2 in which the color-producing reactant material is a metal salt of a phenol-formaldehyde novolak resin.

9. The record sheet material of claim 8 in which the metal is zinc.

10. The record sheet material of claim 2 in which the color-producing reactant material is an ortho-hydroxy aryl carboxylic acid material.

11. The record sheet material of claim 2 in which the ortho-hydroxy aryl carboxylic acid is combined with a metal.

12. The record sheet material of claim 11 in which the metal is zinc.

* * * * *

UNITED STATES PATENT AND TRADEMARK OFFICE

CERTIFICATE OF CORRECTION

PATENT NO. : 4,027,065

DATED : May 31, 1977

INVENTOR(S) : Bruce W. Brockett and Frederick D. Weaver

It is certified that error appears in the above–identified patent and that said Letters Patent are hereby corrected as shown below:

Col. 6, line 47, after the table the following sentences have been inserted,

--- *Typewriter intensity is equal to 100 times the ratio of the reflectance of a printed character divided by the background reflectance. An intensity of 100 indicates no discernible print and a lower value indicates a darker or more intense print. ---.

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*